US005158852A

United States Patent [19]

Sakata et al.

[11] Patent Number: 5,158,852

[45] Date of Patent: Oct. 27, 1992

[54] ELECTROPHOTOGRAPHIC DEVELOPMENT PROCESS

[75] Inventors: Yoshio Sakata, Yamato; Masaharu Iwai; Yasushi Kakehashi, both of Mohka, all of Japan

[73] Assignee: Kanegafuchi Kagaku Kogyo Kabushiki Kaisha, Osaka, Japan

[21] Appl. No.: 615,947

[22] Filed: Nov. 20, 1990

[30] Foreign Application Priority Data

Nov. 22, 1989 [JP] Japan ..... 1-304375

[51] Int. Cl.[5] ..... G03G 9/10

[52] U.S. Cl. ..... 430/106.6; 430/108; 430/126

[58] Field of Search ..... 430/106.6, 108, 126

[56] References Cited

U.S. PATENT DOCUMENTS 2,965,573 12/1960 Gundlach ..... 430/108
4,301,228 11/1981 Kori et al. ..... 430/108
4,640,880 2/1987 Kawanishi et al. ..... 430/106.6
4,698,289 10/1987 Aldrich et al. ..... 430/108

*Primary Examiner*—John Goodrow
*Attorney, Agent, or Firm*—Armstrong & Kubovcik

[57] ABSTRACT

An electrophotographic development process is disclosed, in which a visible toner image is fixed after it is transferred onto transfer members, the visible toner image being formed by a development device equipped with a photosensitive substance for forming a latent image and a visible image, a magnetic field source device, arranged in the vicinity of the photosensitive substance, having a movable member for conveying a developer on the surface and forming magnetic brush, a developement container supporting the magnetic field source device and a developer regulating plate, the improvement wherein the developer is a mixture of carriers and toner, and wherein the carrier are at least one of spherical, substantially spherical, and flake-like shapes and a mixture of at least one kinds of carriers ranging from 30 to 150 μm in average grain size. According to the present invention, motor load is reduced by torque drop, a stirring device and its accessory parts are omitted, and as a result, the development device can be made compact and less costly.

11 Claims, 12 Drawing Sheets

FIG.3
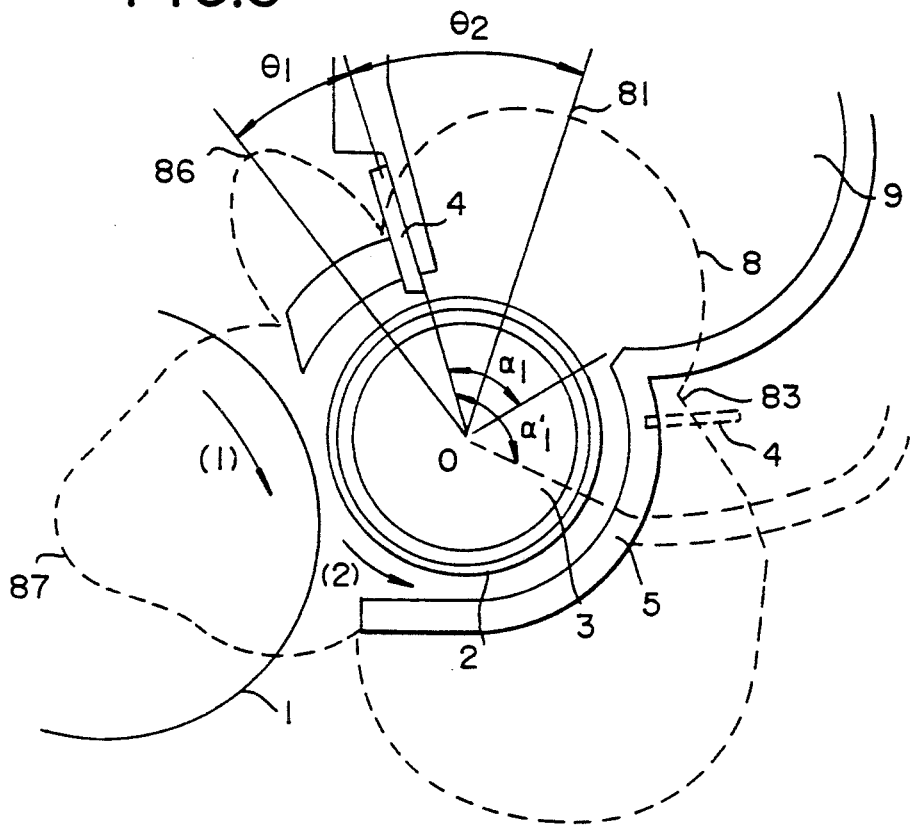
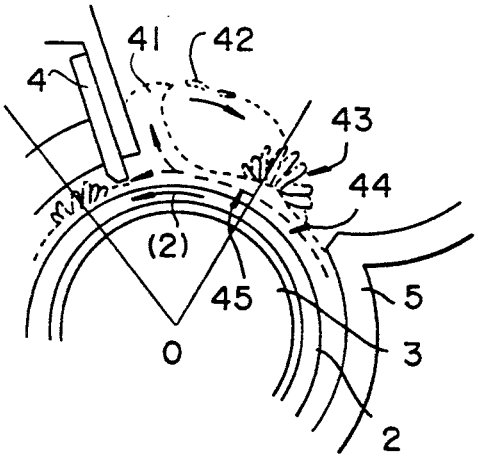
FIG.3A
FIG.3B
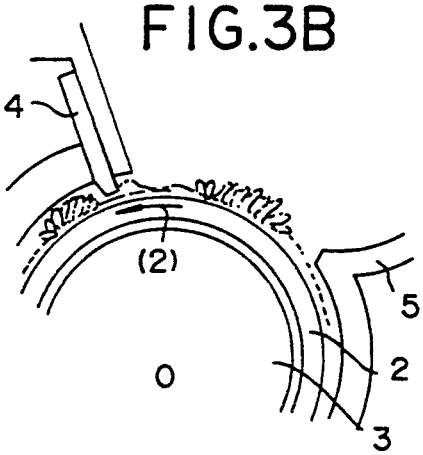

FIG.9
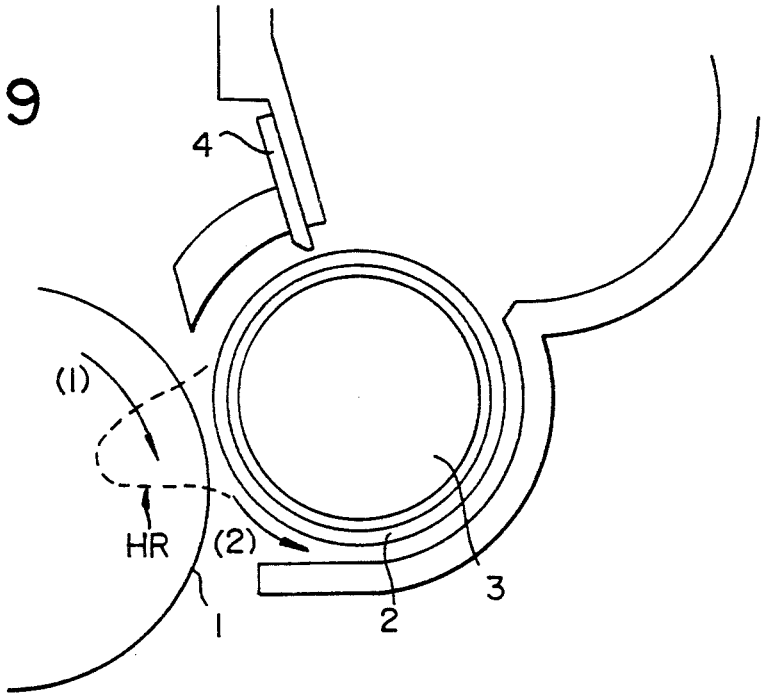
FIG.9A
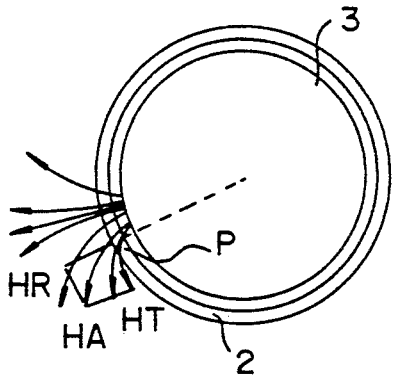
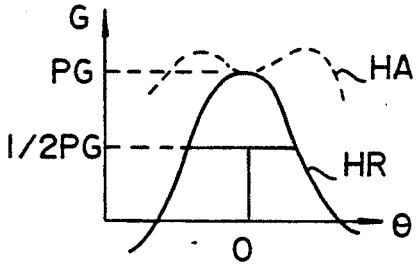
FIG.9B
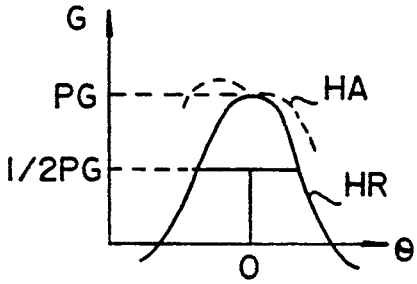
FIG.9C

ELECTROPHOTOGRAPHIC DEVELOPMENT PROCESS

BACKGROUND OF THE INVENTION

1. Field of the Invention

The present invention relates to an electrophotographic development process to prepare printed matters on a copying machine, a printer or a facsimile, wherein an electrostatic latent image on a photosensitive substance is developed with a developer which is a mixture of toner and carriers having different shape and properties. and is formed into magnetic brush by a magnetic field source device, and the toner image is transferred to transfer members such as ordinary paper and resin film and is thereafter fixed.

2. Description of the Prior Art

Electrophotographic development processes are roughly classified into four types;

(1) 2-component development process using carrier such as iron powder and non-magnetic toner, wherein direct current voltage is applied between a photosensitive substance and a non-magnetic and a conductive cylindrical sleeve as a developer conveyer.

(2) 1-component development process using magnetic toner, wherein alternating current voltage and/or direct current voltage are applied between a photosensitive substance and a sleeve.

(3) so-called 1,5-component development process using resin carrier and magnetic toner, wherein direct current voltage is applied between a photosensitive substance and a sleeve, with both the sleeve and a magnet built therein rotated.

(4) so-called new 2-component development process using spherical ferrite carriers and magnetic toner, wherein direct current voltage is applied between a photosensitive substance and a sleeve, with both the sleeve and a magnet built therein rotated.

Those four processes have their own characteristics as follows;

(1) The 2-component development process was established earliest, wherein carrier and toner are mixed by the specified ratio and the toner is charged into specified polarity by frictional charging to deposit them to portions of electrostatic latent images on the photosensitive substance. It is a favorable process because the copy is easy to perform, and it is suitable for color printing, which tends to prevail lately, since it uses toner containing no magnetic materials. However, there are the following problems: as a stirring means and a toner concentration monitor are necessary to charge the toner and the carrier in good conditions and to control the concentration of the developer consumed toner to be uniform, a large-sized and complicated development device is needed, resulting in cost increase; as carrier which has been used for specified duration deteriorate, it must be exchanged; as iron carrier is flake-like and poor in fluidity, it tends to require a high power driving system.

(2) A process for using conductive magnetic toner was devised for the 1-component development process in order to solve the problem on stabilization of the toner concentration by using the stirrer, which is a disadvantage of the 2-component development process. However, this is unappropriate because the images on the matters from using a photosensitive substance repeatedly, which is desired in nature, are obsure, even if the printing matters can be directly obtained. Accordingly, a process in which insulative magnetic toner is used to solve those problems, has been established to obtain, under the same sensitivity body potential conditions as those of the 2-component development process, clear images by devising such toner as is added with charging control agents inside or outside the toner. However, as the charging quantity improved, there were inconveniences that charging cohesion of the toner arose easily to cause the toner deposit on a toner regulating plate, which brought about white lines in the images from development deficiency due to toner deficiency.

By the way, a process for employing, as development bias voltage, voltage obtained by piling up alternating current voltage on the alternating current voltage or the direct current voltage, is known as a so-called jumping process. It is a one step advanced process than that for applying only direct current voltage, since magnetic brush formed by a developer does not directly contact with a photosensitive substance and the development is carried out by toner clouds generated by toner oscillation caused by the alternating current component of the bias voltage, which is capable of obtaining clear images. However, like an ordinary 1-component development process using direct current voltage as the bias voltage, this process has to be raised in accuracy of dimensions and shape of a sleeve as a developer conveyer so as to quantify an amount of charging and an amount of toner. In addition, the process bears production difficulties such as requiring uniformity of the surface unevenness created by sand blast, which lead to high production cost, and also bears problems of generating the white line due to the toner cohesion.

(3) The so-called 1.5-component process using resin carrier was devised to avoid damages due to scratching the surface of a photosensitive substance with carrier, which is a problem of the 2-component development process, and to prevent the deterioration of image quality due to the carrier deposition. That is, damages or short life of the photosensitive substance, caused by carrier intensively scratching the surface of the photosensitive substance is not only prevented, but also image quality deterioration due to existence of light spots in black image portions from the carrier deposition, can be avoided by employing resin carrier with the same component in nature as that of the toner, so as to come to the same phenomenon as the toner deposition upon the images even if the carrier deposition takes place. However, this is basically of a 2-component system, and thus density irregularity arises, unless a mixing ratio between the carrier and toner is within the specified values. Especially, when a stirrer is not employed and high density printing matters are continuously intended to be obtained, an amount of toner consumed increases greatly to thus result in the density drop.

(4) The so-called new 2-component development process using spherical ferrite carriers was devised to prevent charging cohesion which arises with an increase in charge amount of insulate toner, and to solve dropout due to toner deficiency upon development, which are problems associated with 1-component development process using magnetic toner. This process is effective for preventing the charging cohesion, but as described in Japanese Patent Non-examined Publication No. 59-182464 and U.S. Pat. No. 4,640,880, in order to obtain a favorable image, it is necessary to rotate both of a cylindrical sleeve and a magnet built therein and, especially, it is necessary to rotate them reversely with each other and, moreover, to make a conveyance direction of the toner the same with a moving direction of the photosensitive substance. This results in cost increase from needing a high power driving system to rotate a magnet with large mass at high speed, gears to transmit the driving force and costly rolling bearings to get smooth rotation. In addition, wrong balancing gives rise to vibration to cause noise.

SUMMARY OF THE INVENTION

An object of the present invention is to eliminate drawbacks associated with the conventional technology mentioned above and to provide an electrophotographic development process which is applicable to either case using non-magnetic toner or magnetic toner, and which can obtain high quality printing matters at low cost.

Another object of the present invention is to provide an electrophotographic development process capable of reducing motor load due to torque drop.

Still other object of the present invention is to provide an electrophotographic development process which can dispense with a stirrer and its belongings, make the device to be small-sized and inexpensive.

The other objects and advantages of the present invention will be made apparent to those skilled in the art through reading the following detailed description.

BRIEF DESCRIPTION OF THE DRAWINGS

FIG. 3 is a schematic illustration showing an embodiment of a development process of the present invention; FIGS. 3A and 3B are enlarged illustrations of essential parts.

FIG. 9 is a schematic illustration showing magnetic field distribution of development poles; FIGS. 9A, 9B and 9C are schematic illustrations showing magnetic field distribution (relationship between HA and HR) of development poles, respectively.

DETAILED DESCRIPTION OF THE INVENTION

Figure 1:
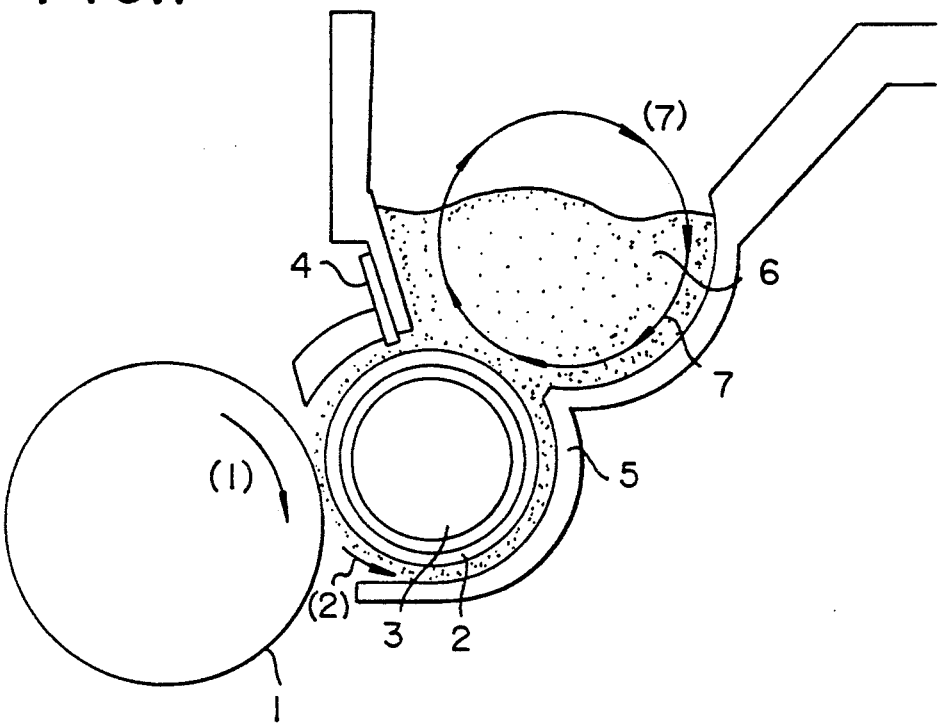
FIG. 1 is a schematic illustration showing a conventional 2-component development process.

The present invention relates to an electrophotographic development process in which a visible toner image is fixed after it is transferred onto transfer members, the visible toner image being formed by a development device equipped with a photosensitive substance for forming a latent image and a visible image, a magnetic field source device, arranged in the vicinity of the photosensitive substance, having a movable member for conveying a developer on the surface and forming magnetic brush, a development container supporting the magnetic field source device and a developer regulating plate, the improvement wherein the developer is a mixture of carriers and toner, and wherein the carriers are at least one of spherical, substantially spherical, and flake-like shapes and a mixture of at least two kinds of carriers ranging from 30 to 150 μm in average grain size.

The present invention can solve the problems in the conventional electrophotography, regardless of using non-magnetic or magnetic toner.

As carriers used in the present invention, it is preferable to prepare them by mixing carriers different in average grain size, more preferable, to prepare them with a ratio of carriers greater in the average grain size higher.

In addition, it is more preferable to use spherical or substantially spherical carriers for one component to be mixed. Besides, it is still more preferable to lower volumetric specific resistance of carriers less in mixing ratio. It is preferable to use a magnetic field source device giving magnetic field distribution waveforms unsymmetrical in a circumferential direction, and besides it is preferable to provide a magnetic pole (hereinafter called a stirring pole) upstream (in a developer progressing direction) from a developer regulating plate (hereinafter called a doctor blade), other than a magnetic pole (hereinafter called a doctor pole) downstream.

The present inventors applied, based on the above idea, to a 2-component development device using non-magnetic toner and a 1-component development device using magnetic toner, and found out that stabilization of the toner concentration due to torque drop and improvement in stirring performance, and dispensation with a stirrer were attained for the conventional 2-component development device, and disappearance of white lines due to insufficient development caused by massed toner and high resolution under high density printing conditions were realized for the latter 1-component development device, thus completing the present invention.

In the following, the present invention will be explained in more detail.

The carriers used in the present invention are made of fine grains of ferrite, iron, steel, etc. The ferrite carrier is spherical or substantially spherical, and made from a sintered body composed of oxides of nickel, zinc, manganese, magnesium, etc. and trivalent iron oxide ($Fe_2O_3$).

This carrier is chemically stable and free from rust generation during the usage, but in order to make it highly resistant, the surface may be coated with a resin. Iron and steel carriers are substantially spherical or flake-like, and the surfaces are coated with an oxide film or a resin to prevent deterioration of the magnetic permeability due to the rust generation.

The first effect from applying the present invention to the conventional process is obtained by using carriers which comprise a mixture of at least two kinds of carriers ranging from 30 to 150 μm in an average grain size.

FIG. 1 is a schematic illustration showing the conventional 2-component development process. In FIG.

1, a photosensitive substance (1) rotating in an arrow direction (1) and development container (5) opposing thereto are arranged. In the container (5), there are a non-magnetic cylinder (hereinafter called a sleeve) rotating in an arrow direction (2), and a fixed magnetic roll (3) housed in it, and besides, there are a developer (6), a stirrer (7) to stir the developer and a doctor blade (4) to regulate an amount conveyed of the developer (6) as well.

Figure 12:
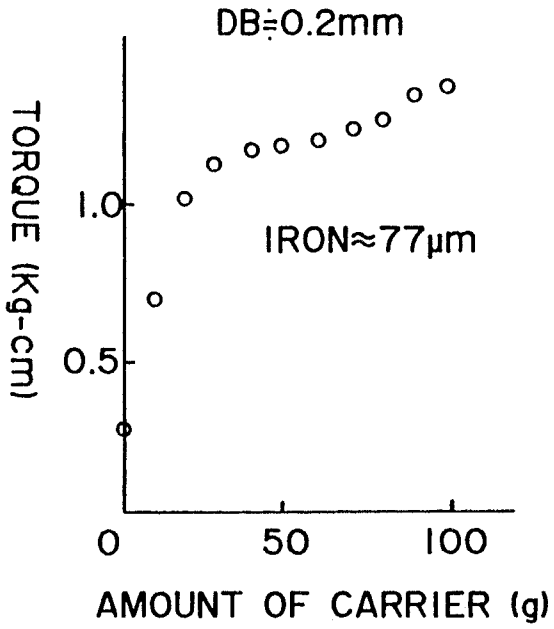
FIG. 11, FIG. 12, FIG. 13A, FIG. 13B, FIG. 13C, FIG. 14A, FIG. 14B and FIG. 14C are graphs showing relationships between carriers and torque, respectively.
Figure 11:
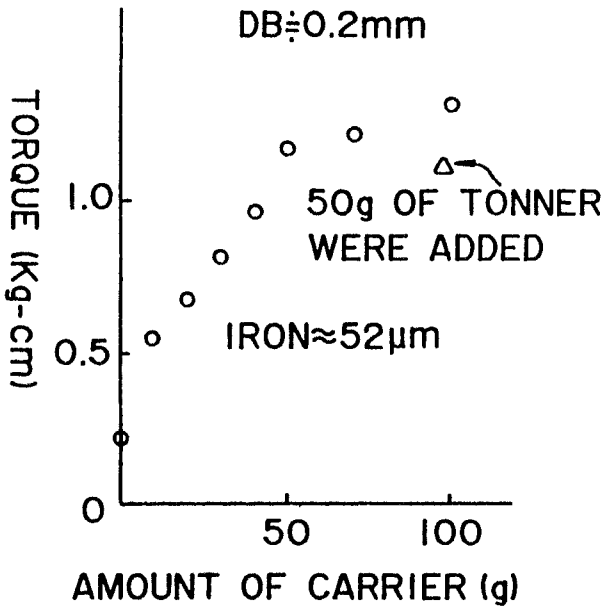

In this conventional process, when the developer (6) was conveyed through a gap between the sleeve (2) and the doctor blade (4) by the rotation of the sleeve (2), large torque to rotate the sleeve (2) was needed because the carriers are of flake-like iron or steel particles to cause poor fluidity and great saturated magnetization quantity of about 170 to 200 emu/g, so that the developer is strongly drawn during conveying. For example, in case that the sleeve (2) in FIG. 1 is with 20 mmϕ and about 230 mm in axial length, and the iron carriers with 52 μm in average particle size as shown in FIG. 11 is used, large torque of 1.3 kg-cm is needed to rotate the sleeve (2). In case of an ordinary developer containing toner, the toner acts as a lubricant to reduce the torque by about 0.2 kg-cm. However, it is apparent even from the case where iron carriers changed in the average grain size to 77 μm show high torque of 1.4 kg-cm as depicted by FIG. 12 that flake-like iron carriers are one of causes for high torque of the developer.

Figure 13B:
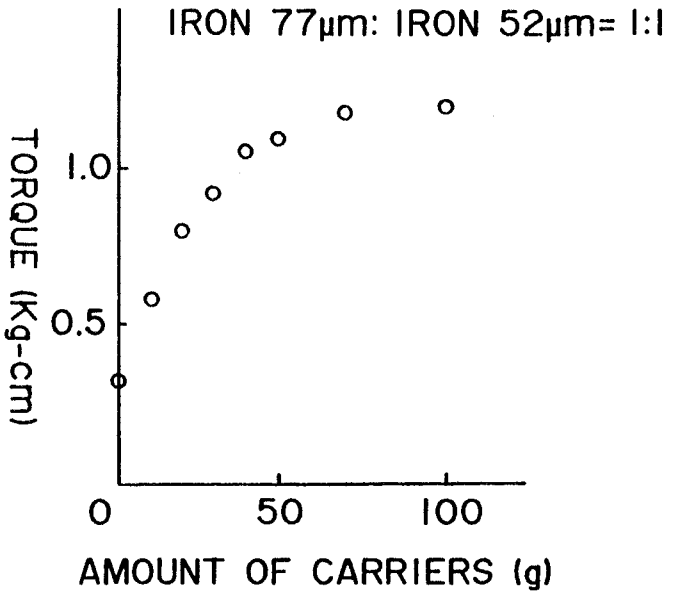
Figure 13A:
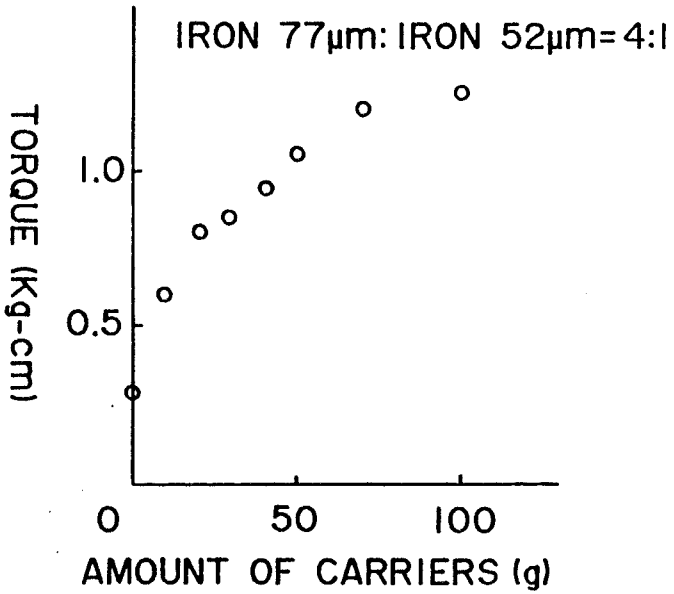
Figure 14A:
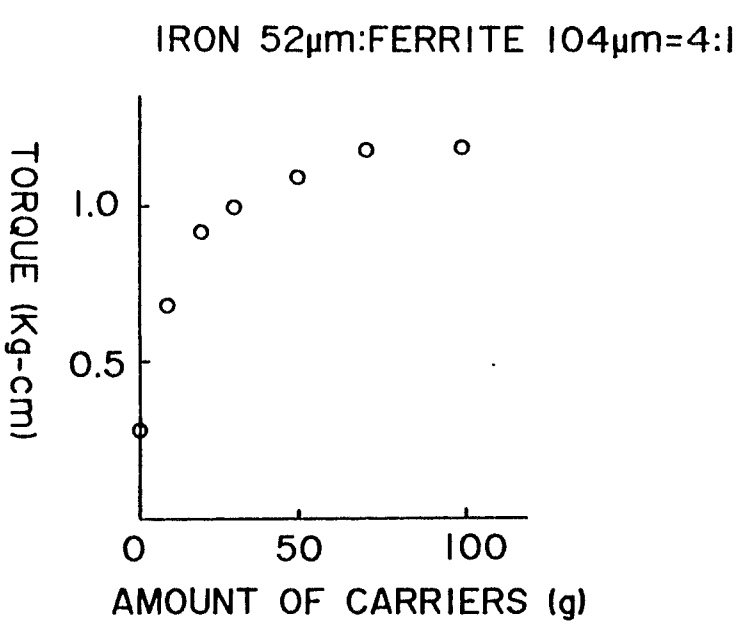
Figure 13C:
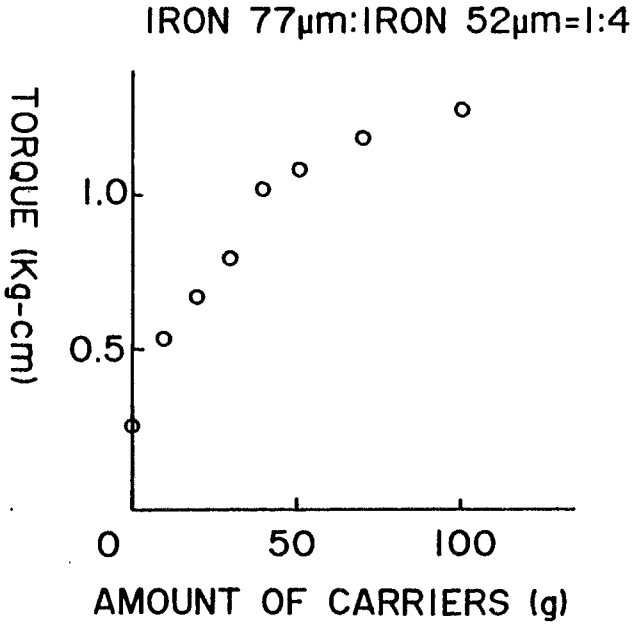
Figure 14C:
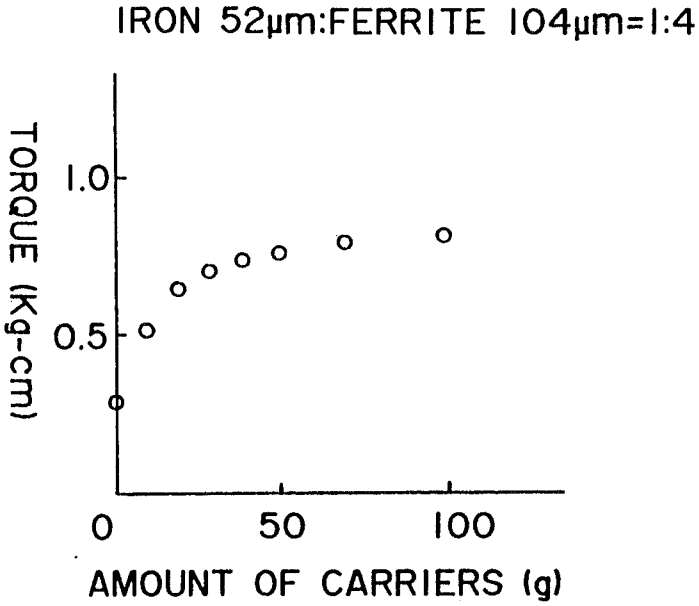
Figure 14B:
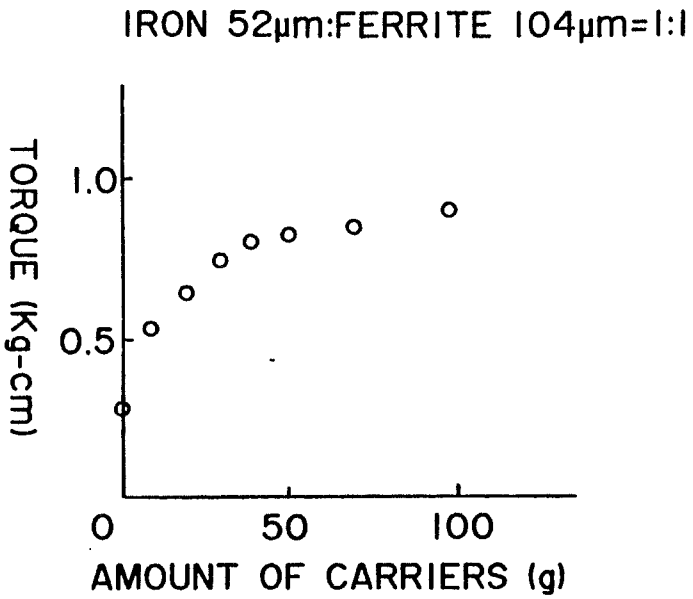
Figure 15:
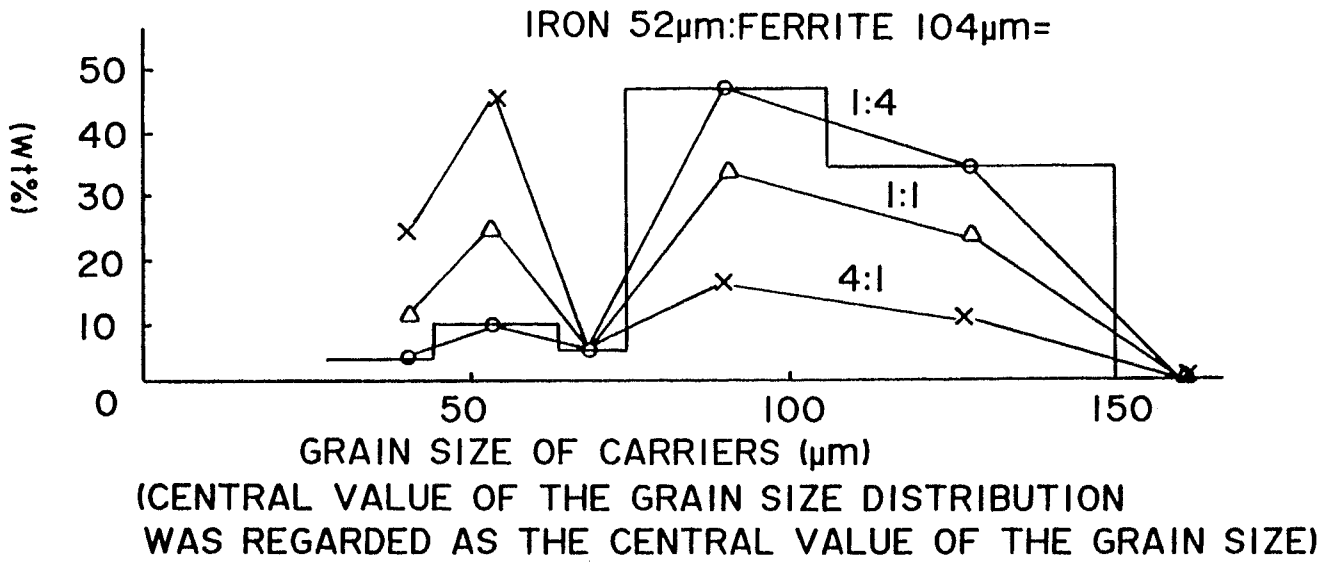
FIG. 15 is a graph showing the grain size of the carriers and the distribution.

Based on the above knowledge, the present inventors studied to realize the torque drop of the developer by lowering torque of the carriers. For a start, as carriers with different average grain sizes, ones with 52 μm and ones with 77 μm were selected to be mixed, and torque was measured. As shown in FIGS. 13A–13C, about the same torque as before was obtained to exhibit no effects on the torque drop. In the next place, when the torque was measured on carriers mixed of spherical or substantially spherical ferrite carriers, 104 μm in average grain size and iron carriers, 52 μm in average grain size, the results shown in FIGS. 14A–14C were obtained. Once reason for such torque drop is thought that the ferrite carriers are spherical or substantially spherical, but selecting the mixing ratio for carriers with larger average grain size to occupy the majority, preferably for the most part as shown in FIG. 14C, drastic torque reduction can be realized. The grain size distribution of carriers in this case is as shown in FIG. 15. It is needless to say that the mixture not only carriers with the above average grain sizes, but also those with different average grain sizes, which are adjusted, as a result, to take grain size distribution similar to FIG. 15, has the similar torque effect as well. At any rate, it can be said to be extremely effective when the present invention is applied to the conventional 2-component development process, because, as made clear from comparing FIG. 11 and FIG. 14C, the torque was dropped from 1.3 kg-cm to 0.8 kg-cm for a case of carriers only, and 1.1 kg-cm to 0.65 kg-cm for a case of a developer containing toner, which amounts to torque drop of about 40%. Hereupon, when an amount of carriers is over 110 g to touch the stirrer (7) as shown in FIG. 1, a torque increase arises regardless of combination of kinds and the average grain sizes of the carriers, but this does not spoil the spirit of the present invention.

The second effect obtainable by applying the present invention to the conventional processes are as follows, and they can be obtained by providing, upon usage of the carriers mentioned above, a stirring pole having a stirring effect of the developer.

Figure 2:
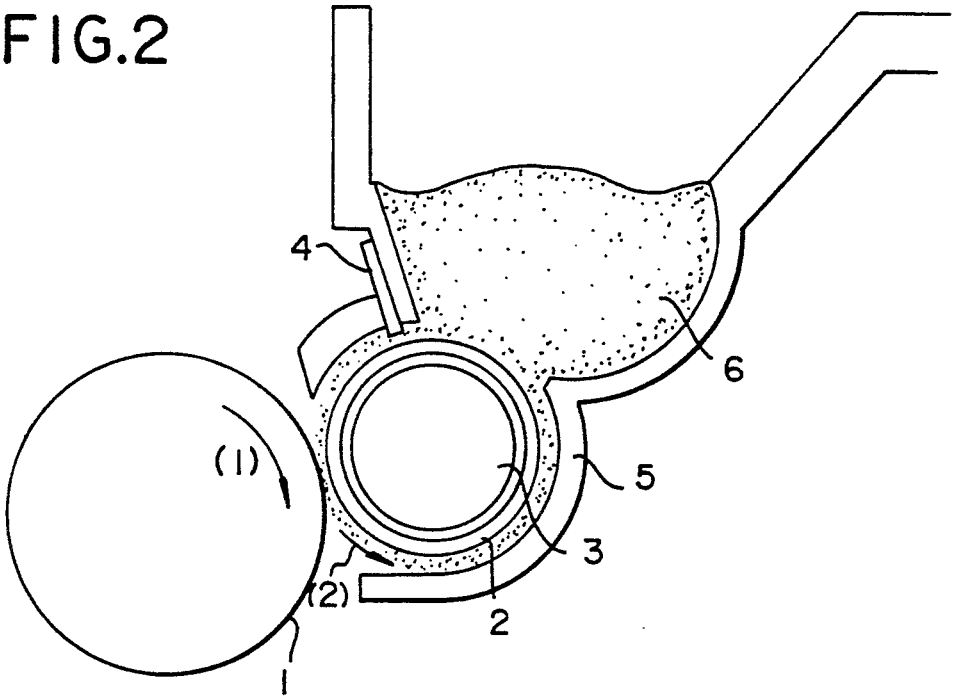
FIG. 2 is a schematic illustration showing a conventional 1-component development process.

Here, FIG. 2 is a schematic illustration showing a conventional 1-component development process, the fundamental construction of which is the same as that shown in FIG. 1, but as the carriers are not contained in the developer, the stirrer needed in the 2-component development system is not provided. As mentioned above, the 1-component development system is low in cost from dispensing with various parts such as the stirrer and gears attached thereto and excellent in solving problems including stabilization of toner concentration, but it gives rise to white lines caused by toner cohesion. The process having solved these problems is a so-called new 2-component development process in which spherical carriers are used in addition to magnetic toner, a sleeve is rotated in a direction conveying the toner and the carriers and a magnet roll is rotated at high speed in the reverse direction. This process can, like the 1-component development process in FIG. 2, dispense with added devices such as the stirrer for the developer increasing the cost, and provide a process to solve the problem of white lines caused by the toner cohesion which the 1-component development system has. However, this resulted in presenting new cost-up factors including such as the necessity of a high power driving system to rotate a high weighing magnet, gears to transmit the power and costly rolling bearings.

On the other hand, a process having been devised, from another view point, to solve the problems born in the 2-component development process is the so-called 1.5-component process. In the process, as countermeasures to problems in the 2-component development process, of image quality drops due to existence of light points in black image portions caused by carrier adherence, resin carrier with substantially the same composition as the toner is used, a sleeve is rotated in a direction conveying toner and carrier and a magnet roll is rotated in the reverse direction. In this way, this process has succeeded in dispensing with the stirrer as in the 1-component development process in FIG. 2. However, this process came as well to bear the problem caused by the necessity to rotate at high speed the high weighing magnet, as in the process to use the ferrite carriers and the toner. In order to solve the problems mentioned above, the present invention provides a process of dispensing with various devices inviting cost increase, in which magnetic poles formed by magnetic field distribution (8) caused by a magnetic roll act as stirring poles giving stirring action, so that if only the sleeve rotates, the magnetic roll may be fixed.

Figure 4:
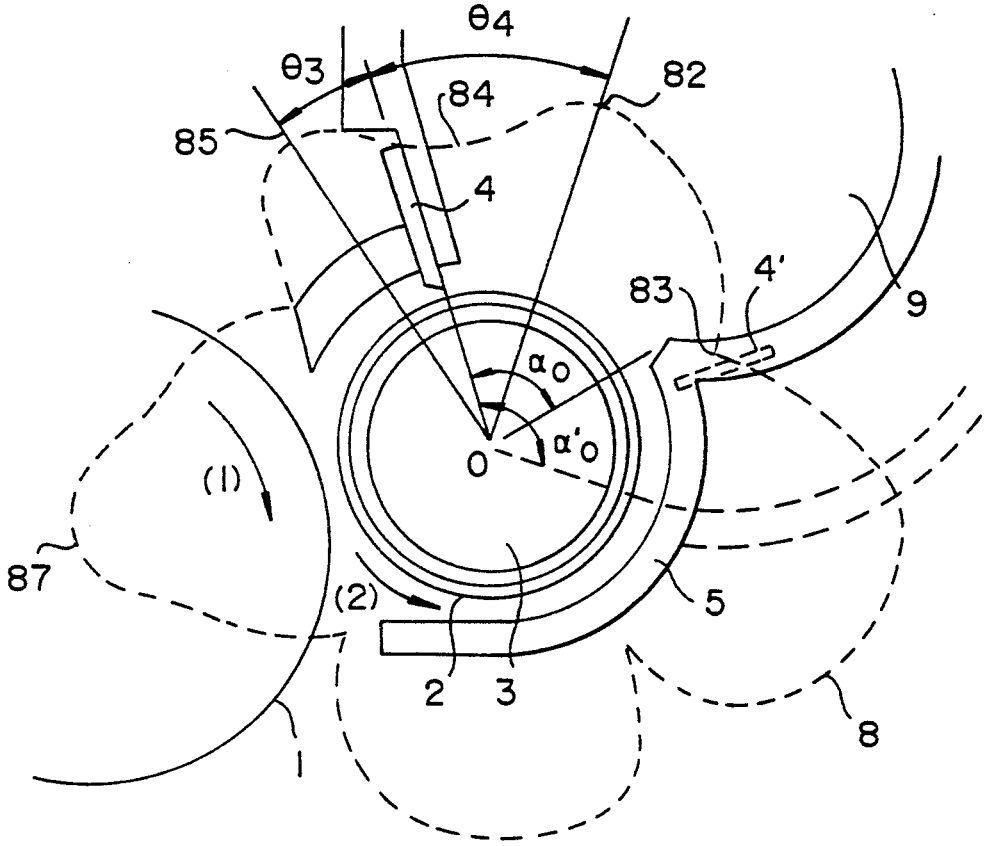
FIG. 4 is a schematic illustration showing another embodiment a development process of the present invention.

There are two kinds of the stirring poles concerned with the present invention; one is a pole (81) with magnetism different from that of the doctor pole as shown in FIG. 3; the other is a pole (82) with the same magnetism as that of the doctor pole as shown in FIG. 4. The both have the same stirring effect, but their manners are different from each other.

In case where the stirring pole is different in the magnetism from the doctor pole as shown in FIG. 3, the stirring action is carried out by convection stirring. As shown in FIG. 3 and FIG. 3A, when the sleeve rotates in an arrow direction (2), the developer is partly conveyed to the vicinity of a photosensitive substance (1) through a gap between the doctor blade (4) and the sleeve (2), so that the development is carried out by toner in the developer which adhere to an electrostatic latent image on the photosensitive substance (1). If the conveyance is made consecutively by the rotation of the sleeve (2), carrier stay (41) arises before the doctor blade (4), and when the amount overs the specified one, the carriers partly form carrier chain (42) flying to carrier ear (43) formed by backward magnetic poles. If this is repeated, upper toner is involved in the carriers by the carrier movement and the stirring is made. For making the convection stirring properly, the amount of carriers and the positions of the magnetic poles must be set at appropriate conditions. The amount of carriers must be sufficient to give rise to the carrier stay (41) before the doctor blade (4) as shown in FIG. 3A. If the carriers are less as shown in FIG. 3B, though the stirring is not needed because there are many gaps among carriers, toner in the developer becomes excessive to cause unfavorable effects including fog on image quality upon the development. If the carriers are too much, a space region in which the foregoing action arises falls into the whole of the carriers, so that enough stirring action cannot be expected. For example, in FIG. 3, in case where the sleeve (2) is 20 mm$\phi$ and about 230 mm in axial length, and a gap between the doctor blade (4) and sleeve (2) is about 0.3 mm, it is preferable that the amount of carriers enough to cause the convection stirring as shown in FIG. 3A is 15 to 180 g.

With respect to the position of the magnetic pole, unitary determination of an angle $\theta_1$ made between the doctor pole and the doctor blade in FIG. 3 cannot be made because conveying force of the developer differs depending on magnetic field distribution and magnetic field strength of the doctor pole, but it is generally set at 5 to 35°. The minimum and maximum values of an angle $\theta_2$ between the stirring pole and the doctor blade are determined by the necessity of causing the carrier stay (41) and the backward fly of the carrier chain (42). If $\theta_2$ is below 10°, enough stay cannot take place, and if $\theta_2$ is over 80°, the backward fly of the carrier chain cannot occur, and thus $\theta_2$ is preferably 25° to 65°. When the amount of carriers and the angle between the doctor blade and the stirring pole are comprehensively understood, preferable conditions are still narrowed. If the amount of carriers is comparatively less and $\theta_2$ is less, the backward fly of the carrier chain (42) frequently occurs, so that the amount of toner taken becomes great to cause fog in the image, and on the other hand, if the amount of carriers is greater and $\theta_2$ is greater, the frequent backward fly of the carrier chain (42) is reduced, so that it becomes difficult to comply with high consumption of the toner.

From the above viewpoints, it is preferable that the amount of carriers is 30 to 150 g and the angle $\theta_2$ is 30° to 55°. Hereupon, an opening angle $\alpha_1$ looking at the toner bath (9) from sleeve rotation center 0, had better be greater to take in the toner easily, being about 80° in FIG. 3, but it is more preferable to widen it to $\alpha_1'$ and to make plural regions of carrier convection, which is easily made possible by providing a regulation plate (4') corresponding to the doctor blade, near a reversed polarity portion (83) of the magnetic pole.

Figure 4A:
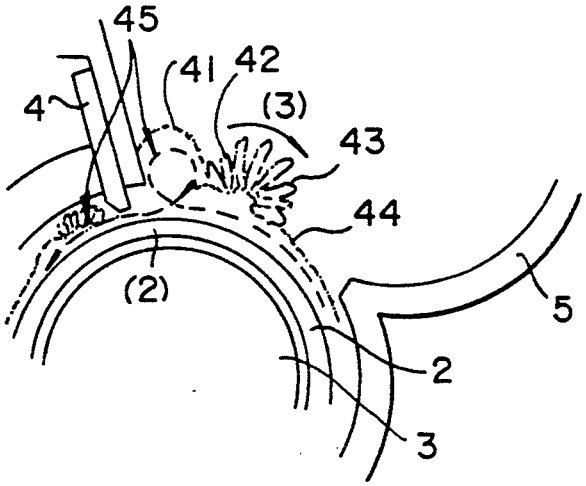
FIG. 4A is an enlarged illustration of an essential part.

In case where the stirring pole is the same in the magnetization as that of the doctor blade as shown in FIG. 4, the stirring action is performed by screw stirring by carriers, formed by magnetic force of the stirring pole. When the sleeve (2), as shown in FIG. 4 and FIG. 4A rotates in an arrow direction (2), the developer is partly conveyed to the vicinity of the photosensitive substance (1) through a gap between the doctor blade (4) and the sleeve (2), and the development is carried out by toner in the developer adhering to an electrostatic latent image on the photosensitive substance (1). If the conveying is made consecutively by the rotation of the sleeve (2), the carrier stay (41) arises before the doctor blade (4), and when the amount exceeds the specified one, part of the carriers separates and forms the carrier chain (42) to constitute part of the carrier ear, which is formed by the magnetic pole (82) of the magnetic field distribution (8) formed around a magnet roll (3). If this is repeated, the carrier ear is backward fed to thus assimilate with a carrier layer (44). The carrier screw (43) thus formed rotates with the rotation of the sleeve (2) in a arrow direction (3) reverse to a rotating direction (arrow (2)) of the sleeve (2), and at this time, toner in the toner bath (9) over the development container (5) are taken in and stirred in order that proper stirring is made, there are also appropriate conditions on the amount of carriers, and positions of the magnetic poles, as in the case of the convection stirring mentioned before.

That is, the amount of carriers must be sufficient to give rise to the carrier stay (41) before the doctor blade (4) and to form the carrier screw (43), and must not exceed the amount to make the carrier screw (43) fallen in the carrier layer (44) to prevent the stirring action, as shown in FIG. 4A.

In connection with the positions of the magnetic poles, an angle $\theta_3$ between the doctor pole and the doctor blade (4) is optionally set within 5° to 35° depending on conveying force of the doctor pole, and an angle $\theta_4$ must be enough to secure a space needed to form the carrier stay (41) and the carrier screw (43). For example, as in the foregoing one, in case where the sleeve (2) is 20 mm$\phi$ and about 230 mm in axial length, and a gap between the doctor blade (4) and sleeve (2) is about 0.3 mm, it is most preferable that the amount of carriers is 35 to 150 g and that the angle $\theta_4$ between the stirring pole and the doctor blade (4) is within 25° to 60°. Moreover, as in the case of the convection stirring mentioned before, an opening angle $\alpha_0$ looking at the toner bath (9) from the rotation center 0 of the sleeve (2), had better be greater to take in the toner easily, being about 80° in FIG. 4, but it is more preferable to widen it to $\alpha_{0'}$ and to provide a regulation plate (4') corresponding to the doctor blade, near a reversed polarity portion (83) of the magnetic pole to thus jointly use stirring action through convection. By so doing, the stirring action of the carriers and the toner becomes still more effective.

Figure 5:
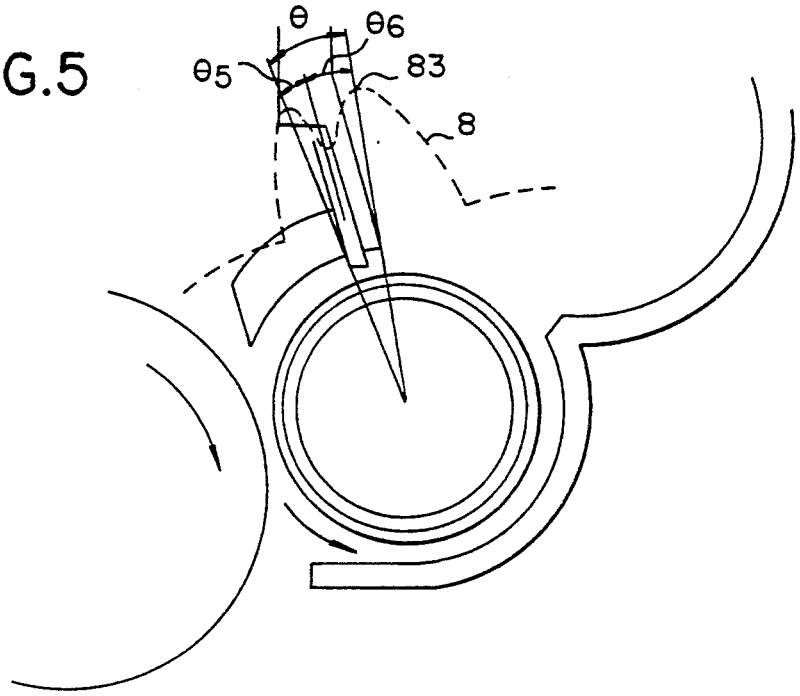
FIG. 5 is a schematic illustration showing a conventional development process.

Hereupon, as an example of positioning the same kind of the magnetic poles near the doctor blade, there are included the followings; one using the magnetic pole with double peak shown in FIG. 5 to thus expect regulation of the developer under less torque (here, $\theta \approx 20°$ to 30°, $\theta_5 \approx 10°$ to 16°, $\theta_6 \approx 10°$ to 16°); Japanese Patent Non-examined publication No. 59-231556 expecting the prevention of leak of magnetic body; Japanese Patent Non-examined publication No. 61-166571 expecting formation of thin films of the developer. However, the carrier stay and the carrier screw, which are essential in the present invention, are not formed in either case, so that they are quite different from the present invention, though they resemble.

The toner efficiently taken into the carriers under the above conditions is conveyed along the carrier flow (45) and advances to the carrier stay (41) where it convects as shown by broken lines, and partly passes through a gap between the doctor blade (4) and the sleeve (2) to thus contribute to the development, the rest is mixed among the carrier chains during the convection and fed backward with the rotation of the carrier screw (43) to be supplied with additional toner. Through this repetition, the toner concentration in the developer comprising the carriers and the toner is rapidly enhanced to be stable at the specified concentration.

Hereupon, as mentioned in paragraph on the first effect of the present invention, under ordinary developer conditions in which the toner is added to the carriers, the magnitude of the carrier screw (43) becomes small as compared with a case of carriers being used singly because the toner in the developer acts as a lubricant. In the case of using ferrite carriers, the magnitude of the carrier screw (43), which is about 15 to 20 mmϕ in the case of carriers alone, becomes small to be about 10 to 15 mmϕ immediately after the toner is added. Though there is no difference in stirring action, if more efficient stirring is desired, it is preferable to adopt the following combination among combinations of carriers different in the average grain size which allows the first effect; the ferrite carriers with, for example, about 104 μm as those greater in average grain size and flake-like iron carriers with, for example, about 52 μm and about 170 to 200 emu/g in saturated magnetization as those smaller in the average grain size is more recommendable than the combination of ferrite-ferrite with 20 to 80 emu/g in saturated magnetization.

As stated above, using an example of 1-component development process as shown in FIG. 2, stirring of the carrier and the toner was explained in cases in which the magnetic polarity is different or the same between the stirring pole and the doctor pole. There is some difference in mobility between magnetic toner and non-magnetic toner; the former moves with carriers by being worked by electric and physical force by the carriers and directly accepts affect from magnetic force of a magnetic roll as well; the latter moves only by electric and physical force from the carriers. However, the stirring action of the carriers and the toner of the present invention is effective regardless of toner magnetism. Accordingly, when the present invention is applied to the 2-component development process as in FIG. 1, the stirrer is not needed and thus the process is capable of dispensing with accessory parts such as gears to transmit stirring force, thus being favorable in cost.

Hereupon, if there are any different considerations to be paid upon usages of the magnetic toner or non-magnetic toner, the following may be pointed out; in the case of the magnetic toner, its behavior on a development region can directly be controlled by magnetic force of the magnetic roll, and therefore, even if the toner concentration in the developer is comparatively high, it is possible to obtain high image quality printing matters unless the concentration is ununiform, so that setting the conditions is easy, while in the case of the non-magnetic toner, its behavior on the development region is controlled indirectly through the carriers by magnetic force, and thus, the developer with too high concentration brings about troubles such as fog and resolution drop. For the reasons, it is necessary to control the toner concentration within about 4 to 10 wt %, i.e., setting of the conditions becomes difficult. In addition, the magnetic toner is attracted and conveyed by magnetic force so that the bottom shape of the container need not be considered so much, while the non-magnetic toner becomes wasteful upon formation of a dead space when the bottom shape is like a broken lines in FIG. 3 and FIG. 4, and consequently, it is preferable that the bottom has an angle greater than an angle of repose to make the developer flow down smoothly, and an opening angle being within a working range of the stirring magnetic pole.

In this way, the second effect obtainable by applying the present invention is as follows; a process using magnetic toner and ferrite carrier as a developer, which was improved from the 1-component development process and put into practical use, and a process using magnetic toner and resin carrier as a developer, which was improved from the 2-component development process and put into practical use, have common drawbacks but those can be solved by the present invention. That is, cost-up factors, i.e., usage of a large capacity driving system, extra gears to transmit force and costly rolling bearings are eliminated, generation of vibration due to lack of weight balance is excluded and stabilization of image density due to improved efficiency of stirring is realized. In addition, stirring screws, gears attached thereto, a mechanism to charge toner at a constant rate, etc., which are indispensable in the 2-component development process can be omitted.

Figure 6:
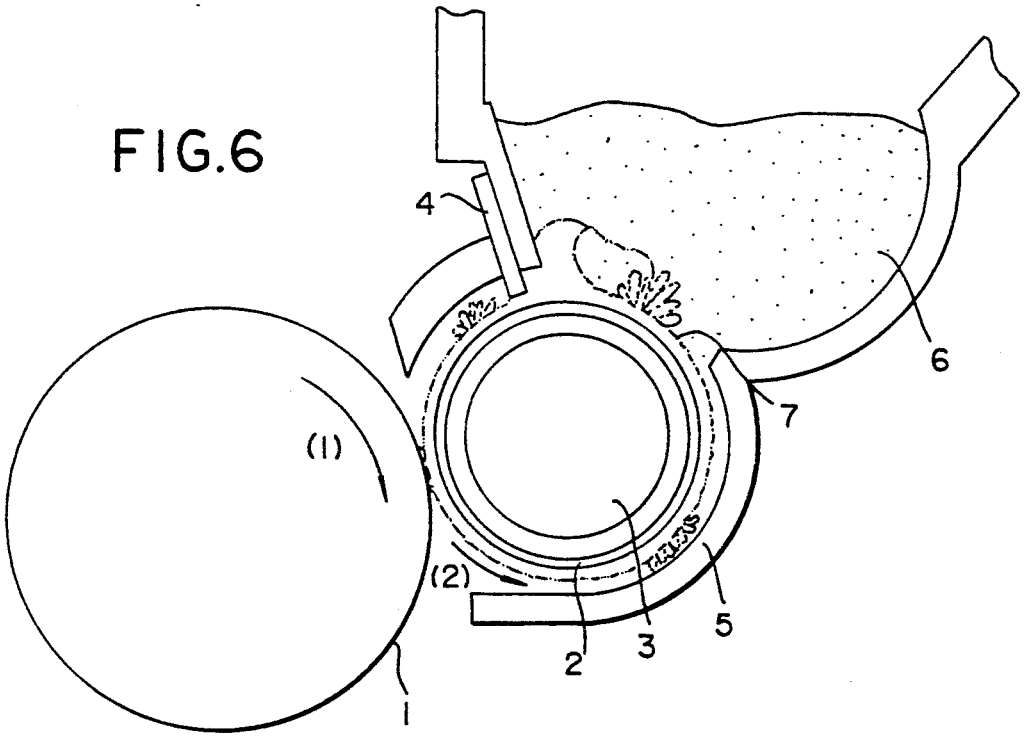
FIGS. 6 and 7 are schematic illustrations for explaining a development process of the present invention.
Figure 7:
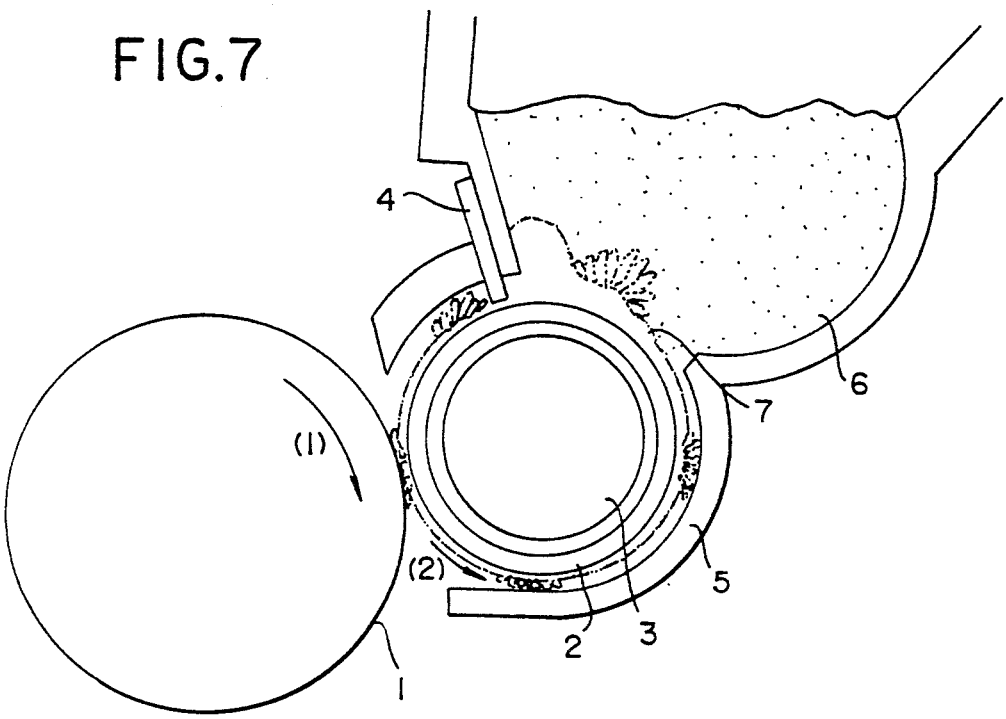

The third effect by applying the present invention is obtained from making different the volumetric specific resistances of carriers differing in the average grain size, which are mixed for use. In constructions as shown in FIG. 6 and FIG. 7, the following development conditions must be taken into consideration; potential of electrostatic image on the photosensitive substance (1), electric and magnetic properties of the carrier (7) and combination of carriers with different average grain sizes, electromagnetic properties of the toner (6), a gap (a doctor gap) between the sleeve (2) and the doctor blade (4), a gap (a development gap) between the photosensitive substance (1) and the sleeve (2), rotational speeds of the photosensitive substance (1) and the sleeve (2), amount of a developer passing through the gap between the doctor blade (4) and the sleeve (2) and toner concentration in the developer, development bias voltage applied between the photosensitive substance (1) and the sleeve (2), magnetic force of the magnetic roll, etc. A development process is determined by making these conditions appropriate.

Figure 8:
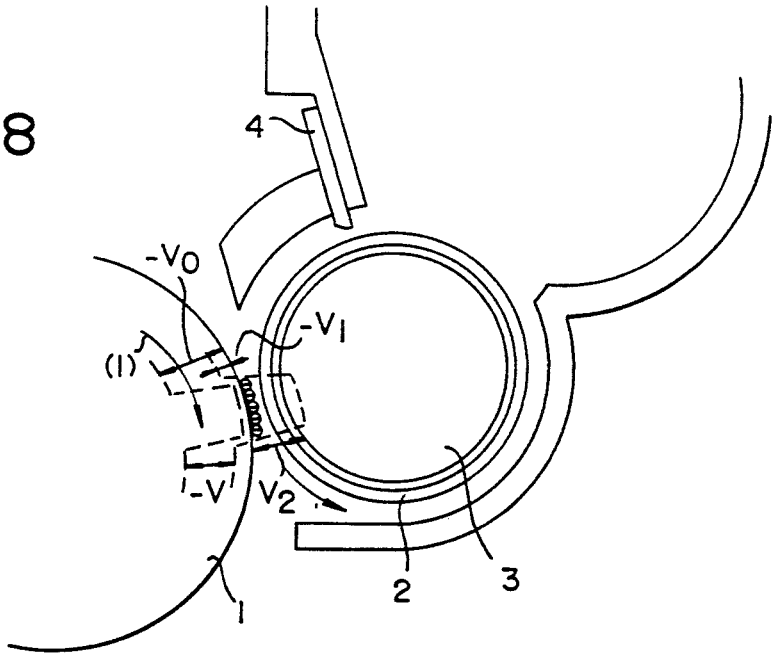
FIG. 8 is a schematic illustration showing potential distribution on the surface of a photosensitive substance.

Preferable ranges for the above conditions are as follows;

The potential of the electrostatic image on the photosensitive substance may be under the same conditions as in the case of insulate toner, being preferable between −750 to −500 V, taking into consideration high potential to obtain high density with ease and low potential to make long the life of the photosensitive substance. The development gap and the doctor gap are preferably within 0.3 to 1.0 mm and 0.15 to 0.6 mm, respectively. The concentration of the toner in the developer is preferably within 4 to 10 wt % as in an ordinary 2-component development process; if it is less than 4 wt %, sufficient image density is difficult to obtain, resulting in being remarkable in grazes, and if it is more than 10 wt %, unfavorable ground stain and fog are liable to arise. In the case of magnetic toner, the toner itself can be controlled by a magnetic roll, and thus higher concentration can be allowed as compared with the case of non-magnetic toner. However, even in this case, the concentration over 25 wt % is unfavorable for obtaining high image quality, because the resolution becomes poor. The development bias voltage varies with electrostatic image potential of the photosensitive substance, magnetic force of a magnetic roll and electromagnetic properties of toner, but is preferably set so that potential of non-development portions is in the order of −5 to −25% of that of development portions. FIG. 8 shows a schematic illustration exhibiting potential distribution on the surface of the photosensitive substance. In the figure, the photosensitive substance (1) is charged at $-V_0$ in voltage by a charger, and the development portion becomes higher in potential by laser irradiation. DC bias voltage −V is applied so that the non-development portion is at $-V_1$ and the development portion is at $V_2$. When potential ratio $-V_1/V_2$ is below −5%, though it is easy to make high the image density measured by a reflection densitometer, toner is apt to deposit on the non-development portion to thus result in unfavorable resolution drop. When potential ratio $-V_1/V_2$ is over −25%, though it is easy to make high the resolution, unfavorable grazes due to deficiency of the image density tend to arise. The rotation speed of the sleeve (2) has a close connection with the conveyance of the developer and toner charging, and the range to be selected varies depending on performances of the toner and the magnetic roll; the low speed results in deficiency of toner charging and conveyance to thus lead to difficulties in obtaining enough density, and inversely, too high speed results in scattering of the toner and the carriers to result in unfavorable image quality.

In consideration of the above conditions, in order to obtain the third effect, i.e., obtaining high resolution upon a high density image from the present invention in which carriers different in the average grain size are combined, the combination of carriers was studied. The results are as follows;

As the carrier greater in average grain size, ferrite carriers are selected as it is preferred that the carrier is used at greater ratio and has spherical or substantially spherical shape and high volumetric resistivity. As the ferrite carrier satisfying these conditions, ferrite mainly made of nickel, zinc and trivalent iron oxide with volumetric specific resistance of not less than $10^8$ Ω-cm or that coated with a resin thereon, ferrite mainly made of manganese, zince and trivalent iron oxide with about $10^3$ Ω-cm in the volumetric specific resistance and raised in said resistance by being coated with a resin on the surface, or ferrite mainly made of manganese, magnesium and trivalent iron oxide with about $10^7$ Ω-cm in the volumetric specific resistance and raised in said resistance by being coated with a resin on the surface are optionally selected. That is, one with the volumetric specific resistance of not less than $10^8$ Ω-cm can be used for the carrier greater in the average grain size, and the carrier may contain other components such as lithium, barium, vanadium, chromium, calcium, etc.

As the carrier small in the average grain size, for decreasing the usage ratio, one with the volumetric specific resistance of not less than about $10^3$ Ω-cm, one figure or more smaller than that of the carrier greater in the average grain size, may be available, regardless of spherical or flake-like shape. As the carrier satisfying these conditions, ferrite mainly made of manganese and zinc with about $10^3$ Ω-cm in the volumetric specific resistance, ferrite mainly made of manganese and magnesium with $10^7$ Ω-cm in the volumetric specific resistance, iron or steel with $10^6$ Ω-cm in the volumetric resistance and coated with oxide films or a resin on the surface, etc. are suitably used.

That is, by making less the resistance of the carrier, smaller in usage ratio among combination of carriers different in the average grain size, excellent charging control function which cannot be expected by the use of high resistance toner is realized. In addition, if usage ratio of the carrier smaller in the average grain size is over 5 wt %, the effects are obtained over an entire scope of the present invention, so that troublesome control of the mixing ratio is unnecessary.

The third effect of the present invention is shown by the following examples;

For a start, ferrite carrier with about $10^9$ Ω-cm in the volumetric specific resistance was used, and the foregoing conditions were controlled so that image density on a reflection densitometer was about 1.40. Development was carried out by a reversal development process, and the surface of the photosensitive substance was charged at about −620 V, irradiated by laser to build up an electro-image, applied with −550 V of development bias voltage and rubbed by the developer. The resolution at this time was about 240 Dot/Inch (hereinafter called DPI).

Next, under the same conditions, the development was made in which carriers were so changed that ferrite carrier ith about $10^7$ Ω-cm in the volumetric specific resistance was selected for the greater grain size carrier, and iron carrier coated with oxide films, with about $10^6$ Ω-cm in the volumetric specific resistance was selected for the smaller grain size carrier. The image density was 0.94 to 1.02, dropped by about 0.45. This is presumably due to insufficiency of toner charging caused by too low resistance of the carrier.

Further, by adopting the same foregoing conditions, the development was made in which carriers were so changed that ferrite carrier with about $10^9$ Ω-cm in the volumetric specific resistance was selected for the greater grain size carrier, and iron carrier coated with oxide films treated by a violet process, with about $10^6$ Ω-cm in the volumetric specific resistance was selected for the smaller grain size carrier. The sufficient image density of 1.38–1.44 was obtained, and printing matters with no toner scattering were obtained and the resolution was 300 to about 400 DPI, giving high image quality.

Meanwhile, the smaller grain size carrier was changed to increase in weight ratio from 5 wt % by 5 wt % and the effect was studied, but in the scope of the present invention, there were almost no changes, giving high image quality. Moreover, the carriers were so changed for the similar study that ferrite carrier with about $10^7$ Ω-cm in the volumetric specific resistance, or with about $10^3$ Ω-cm in the volumetric specific resistance was selected for the smaller grain size carrier, but, either case resulted similarly.

As stated above, preferable carriers are of fine grains selected from iron, steel and ferrite having saturated magnetization of 20 to 200 emu/g, uncoated and/or coated with resin films or oxide films, and have volumetric specific resistance of about $10^3$ to $10^{17}$ Ω-cm. And the carrier greater in average grain size has preferably volumetric specific resistance 10 times or more greater than that of the carrier smaller in average grain size.

The effects of the present invention and the requirement to realize the effects were explained as above. As the magnetic roll used in the present invention, one with plural magnetic poles arranged asymmetrically in the circumferential direction is preferable. Such magnetic roll may be provided by a cylindrical magnet with suitable magnetization, but one with plural magnets with deformed profiles which are arranged around the axis is more preferable, for it is freer in design. As a material, a bond magnet which is formed in a magnetic field by extrusion, injection or a press process from a resin or a rubber into which magnetic fine powders were diffused, is more preferable to sintered ferrite in terms of cost and upgraded magnetic design.

Magnetic field distribution by the magnetic roll is outlined below;

As a development pole, one with magnetic field distribution which is already disclosed in Japanese Patent Non-examined publication No. 63-235973 by the present inventors is preferable. The development pole has magnetic field distribution like HR in FIG. 9, and the HR shows radial component distribution of magnetic force vector HA at an optional point P on the sleeve, the magnetic force originating in the magnetic roll (3) as shown in FIG. 9A. The HA regulates force to arrest toner and carriers and preferable conditions of the development pole are in that the magnetic force vector, adsoute value HA≧PG (peak value of HR), exists, and the range falls within 45° from the center of the magnetic pole (in a HR distribution pattern, the center between separate points made by intersection of half PG value height with the pattern).

Magnetic field distribution near the doctor blade was as described above, but in the case of existence of the same kinds of magnetic poles facing each other with the doctor blade interposed between them, further description will be made.

Firstly, in the conventional 2-component development process, in order to replace used developer which became low in the concentration near a stirring screw, with a developer adjusted to the specified toner concentration, at least 50 gauss or less, preferably almost 0 gauss must be kept for the magnetic force.

Figure 10:
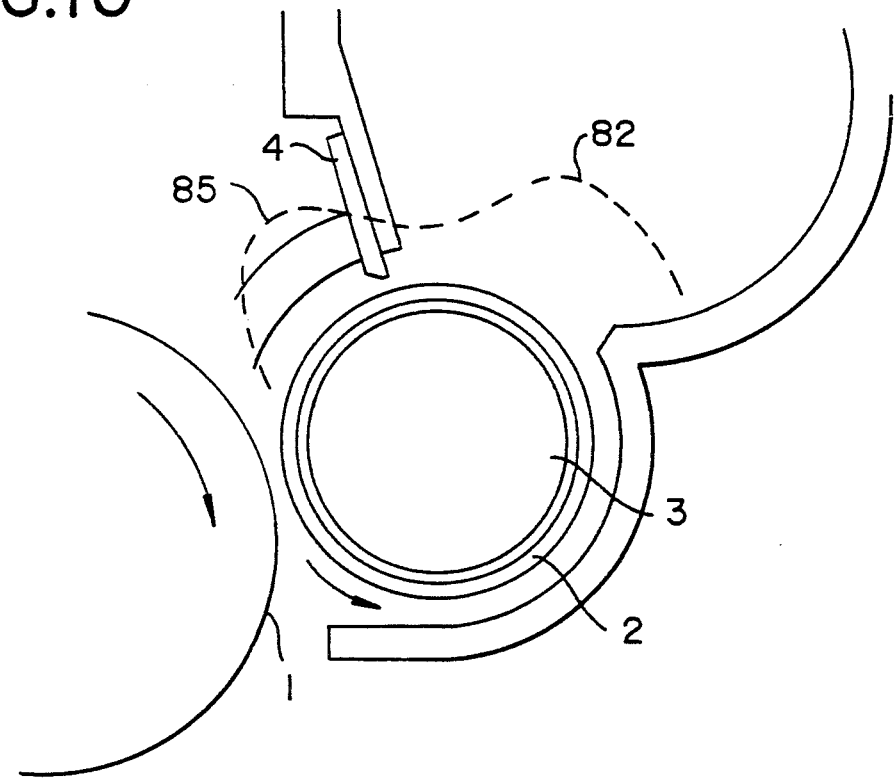
FIG. 10 is a schematic illustration showing magnetic field distribution near a doctor blade.
Figure 10A:
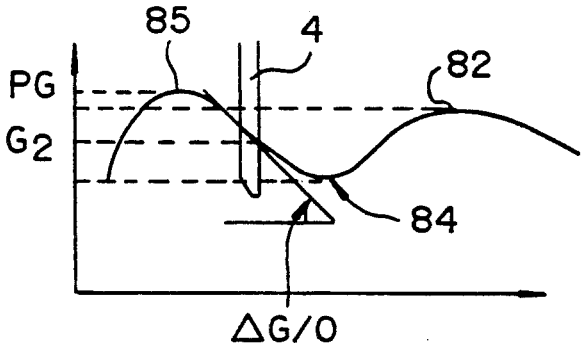
FIG. 10A is a schematic illustration showing distribution quantity of magnetic force.

In the present invention, however, carrier screw is needed to form and thus unfavorable separation of carriers from the surface of the sleeve (2) occurs near 0 gauss. Hence, as shown in FIGS. 4 and 10, it is necessary to work magnetic attraction to carriers even at the trough (84) of the magnetic field distribution between the magnetic poles. Consequently, 50 gauss or more magnetic force is necessary even in the case of iron base carriers high in saturated magnetization of 170 to 200 emu/g. Still stronger magnetic force is needed for ferrite base carriers low in the saturated magnetization, for example, of 20 to 80 emu/g, for example, in the case of carriers with about 60 emu/g, even the magnetic force of about 400 gauss may suffice.

Secondly, a gradient $\Delta G/\theta$ (gauss/degree) of the magnetic field distribution at the doctor blade (4) is shown in FIG. 10. In the case of 2 gauss/1 degree or less, an amount of the developer conveyed is insufficient to result in unfavorable low density in an image, and thus 4 gauss/1 degree or more is needed.

The toner used preferably in the present invention is non-magnetic and has an average grain size of 5 to 15 μm and an absolute value of charging amount of 10 to 35 μq/g, and are mainly composed of a resin made of styrene/acrylic copolymer or a polyester and a non-organic and/or organic colorant, or is magnetic and has an average grain size of 5 to 15 μm, an absolute value of charging amount of 10 to 35 μq/g, and a saturated magnetization of 10 to 50 emu/g, and mainly composed of a resin made of a styrene/acrylic copolymer or a polyester and magnetic fine powder, and a content of the magnetic fine powder is not less than 15 wt. %.

In the following, the present invention is further explained in detail by way of Examples, but the present invention is in no way limited thereto.

EXAMPLE 1

The following conditions were set in the development device as shown in FIG. 2:

(1) OPC photosensitive substance;
about 50 mm in diameter, rotated at about 47 mm/s in peripheral velocity in an arrow direction ①.

(2) Non-magnetic sleeve;
about 20 mm in diameter, about 230 mm in axial length, material-SUS316, rotated at about 47 to 447 mm/s in an arrow direction ②.

(3) Gap (DS) between the photosensitive substance and the non-magnetic sleeve;
about 0.3 to 1.0 mm.

(4) Gap (DB) between a doctor blade and the non-magnetic sleeve;
about 0.15 to 0.6 mm.

(5) Image potential on a photosensitive substance
about −620 V.

(6) Bias voltage;
DC about −300 to −650 V.

(7) Developer (carrier);
① ferrite mainly made of nickel, zinc, and trivalent iron oxide, average grain size—about 104 μm,
electric resistance—about $2\times10^9$ Ω-cm,
saturated magnetization—about 60 emu/g,
usage—about 70 g.
② ferrite mainly made of manganese, magnesium and trivalent iron oxide
average grain size—about 80 μm,
electric resistance—about $3\times10^7$ Ω-cm,
saturated magnetization—about 70 emu/g,
usage—about 3.5 to 18 g.

(8) Developer (toner);
carbon black charging material, silica gel and polyolefine contained in addition to styrene/acrylic resin, about 30% of magnetic powder (magnetite) contained,
average grain size—about 12 μm,
electric resistance—about $4\times10^{16}$ Ω-cm,
saturated magnetization—about 30 emu/g,
charge amount—about −25 μq/g (9) Magnetic roll;
carrier flying type as shown by broken lines in FIG. 3,
magnetic pole (87)—about 890 gauss,
magnetic pole (86)—about 650 gauss,
magnetic pole (81)—about 550 gauss,
$\theta_1$—about 16°,
$\theta_2$—about 39°.

Under the above conditions, transfer to paper and thermal fixing were carried out after reversal development was made by rubbing the photosensitive substance with ears of the developer, printing matters satisfying either of image density ID over 1.2 or resolution over 240 DPI could be obtained under the following conditions; DS—about 0.6 mm, DB—about 0.3 to 0.33 mm (DS/DB≈2), peripheral velocity of the sleeve—235 to 350 mm/s and bias voltage −500 to −600 V. At low peripheral velocity of the sleeve below 235 mm/s, ID dropped to generate remarkable grazes because of shortage of toner chaging. At high peripheral velocity of the sleeve over 350 mm/s, carrier scattering, ground stain and fog arose to result in resolution drop. At bias voltage of −300 to −500 V, ID dropped, and at more than −600 V, ground stain and fog arose to cause resolution drop. When setting the same DS and DB, and 280 to 350 mm/s for peripheral velocity of the sleeve and −500 to −600 V for bias voltage, printing matters satisfying either of ID over 1.3 or resolution over 300 DPI could be obtained. Moreover, by setting the severe conditions to be 310 to 340 mm/s for peripheral velocity of the sleeve and −530 to −570 V for bias voltage, printing matters satisfying both of ID between 1.38 and 1.44 and resolution over 300 DPI could be obtained. Meanwhile, a similar test was made by changing the amount of smaller grain size with low resistance to 3.5 to 18 g and similar results were obtained.

For comparison, a test was made by removing carrier with smaller grain size and considerably satisfactory performance image quality of about ID 1.38 anf resolution of 300 DPI were obtained, but an allowable range of conditions was narrow and conditions satisfying both ID over 1.4 and resolution of about 300 to 400 DPI could not be obtained, from the results of which effects by smaller grain size carriers with low resistance were confirmed.

EXAMPLE 2

Among conditions in Example 1, the following conditions were changed for the test:

(9) Magnetic roll;
carrier screw type as shown by broken lines in FIG. 4,
magnetic pole (87)—about 870 gauss,
magnetic pole (85)—about 660 gauss,
magnetic pole (82)—about 615 gauss,
through of the magnetic poles (84)—about 390 gauss
change of magnetic force at doctor blade (4)—about 6 gauss/1 degree.

In the above conditions, as conveyance of the developer at the doctor blade (4) lowered as compared with that in Example 1, the gap (DB) between the doctor blade (4) and the non-magnetic sleeve (2) was made wider than that of Example 1 to be 0.44 to 0.49 mm and favorable conditions were found out to obtain good printing matters. Under the conditions, DS≈0.6 mm, DS/DB≈1.3 and others being almost the same as in Example 1 including peripheral velocity of the sleeve and bias voltage, favorable printing matters with ID=1.40 to 1.44 and resolution over 300 DPI were obtained. In this Example, the carries formed carrier screw (42) with 15 to 20 mm in diameter, rotated reversely in an arrow direction ③ with rotation of the sleeve (2) and gave toner stirring action. When the toner was fed, the carrier screw (42) became small to be 10 to 15 mm in diameter, which is different from the case of carriers alone. It is presumed that average saturated magnetization of the developer became less and besides, the frictional resistance being reduced by the toner.

EXAMPLE 3

Among conditions in Example 1, the following conditions were changed for the test:

(7) Developer (carrier);
① ferrite mainly made of nickel, zinc and trivalent iron oxide
average grain size—about 104 μm,
characteristics—the same as in Example 1
usage—about 120 g.
② magnetite subjected to violet treatment
average grain size—about 77 μm,
electric resistance—about $1.2\times10^6$ Ω-cm,
saturated magnetization—about 180 emu/g,
usage—about 3.5 to about 30 g.

(8) Developer (toner);
mainly made of styrene/acrylic resin,
average grain size—about 11.5 μm,
electric resistance—about $2\times10^{14}$ Ω-cm,
charge amount—about −24 μq/g (9) Magnetic roll;
carrier screw type as shown by broken lines in FIG. 4, characteristics—the same as in Example 2.

Even under the above conditions, enough conveyance of the developer, as obtained in Example 2, was obtained by making DB greater than that in Example 1, but, the toner was non-magnetic so that the scattering arose easily when the sleeve was rotated at high speed. As a result, the sleeve rotation was limited to a low level and thus, enough charging could not be obtained and the printing matters obtained showed ID of about 1.3 and resolution of about 300 DPI.

It can be said that the above results are practically sufficient, but the conditions were changed to obtain still higher image quality:

(7) Developer (carrier);
① ferrite coated with a resin,
average grain size—about 70 μm,
electric resistance—over about $1\times10^{16}$ Ω-cm,
saturated magnetization—about 65 emu/g,
usage—about 120 g.
② magnetite subjected to violet treatment,
average grain size—about 50 μm,
electric resistance—about $4\times10^5$ Ω-cm,
saturated magnetization—about 180 emu/g,
usage—about 3.5 to 30 g.

That is, among carriers differing in average grain size, as the carrier occupying the larger part of them was employed the carrier with high resistance for the test. As a result, enough charging amount could be given to the toner, even if the sleeve was not rotated at high speed as in Example 1, and favorable printing matters with ID over 1.38 and the resolution over 300 DPI were obtained.

As mentioned above, by applying the present invention to an electrophotographic development device including a copying machine, numerous effects such as reduction in motor load due to torque drop, dispensation with a stirring device and accessory parts and upgraded image quality can be obtained. Moreover, the developing device can be made compact and less costly.

What is claimed is:

1. An electrophotographic development process comprising the steps of:

transferring a visible toner image onto transfer members;

fixing the visible toner image onto the transfer members, the step of fixing the visible toner image comprises the step of forming the visible toner image by a development device equipped with a photosensitive substance for forming a latent image and a visible image, a magnetic field source device, arranged in the vicinity of the photosensitive substance, having a movable member for conveying a developer on the surface and forming magnetic brush, a development container supporting the magnetic field source device and a developer regulating plate, wherein the developer is a mixture of carriers and toner, and wherein the carriers are at least one of spherical, substantially spherical, and flake-like shapes and a mixture of at least two kinds of carriers ranging between 30 μm and 150 μm is average grain size, wherein one kind of carriers has larger average grain size than another kind of carriers.

2. The process of claim 1, wherein a ratio of carriers greater in average in average grain size is raised in the carriers.

3. The process of claim 1 or 2, wherein the carriers are of fine grains selected from iron, steel and ferrite having saturated magnetization of 20 to 200 emu/g, uncoated and/or coated with resin films or oxide films, and have volumetric specific resistance of about $10^3$ to $10^{17}$ Ω-cm.

4. The process of claim 3, wherein the carrier greater in average grain size has volumetric specific resistance 10 times or more greater than that of the carrier smaller in average grain size.

5. The process of claim 1 or 2, wherein a magnetic field source device is composed of a movable part made of a non-magnetic cylinder and a fixed magnetic roll with plural magnetic poles arranged asymmetrically in the circumferential direction which is built in the cylinder, and an absolute value of magnetic force vector HA is greater than that of the radial component HR of a development pole which exists near the development pole, which is expressed by $|HA| \geqq |HR|$.

6. The process of claim 1 or 2, wherein, in order that the carriers fly upstream before a developer regulating plate, a convection stirring magnetic pole, which has a different polarity from that of a doctor pole standing downstream with the developer regulating plate interposed therebetween, is formed by the magnetic field source device, and an angle between the developer regulating plate and the convection stirring magnetic pole is 25° to 60°.

7. The process of claim 1 or 2, wherein, in order to form a carrier screw upstream of a developer regulating plate, two magnetic poles with the same polarity by the magnetic field source device are formed with the developer regulating plate interposed therebetween, magnetic force of at least 50 gauss or more exists at troughs of magnetic field distribution between magnetic poles, an angle between a magnetic pole upstream and the developer regulating plate is 25° to 60° and a gradient of magnetic field distribution at the developer regulating plate is not less than 4 gauss/1 degree.

8. The process of claim 1 or 2, wherein the toner is non-magnetic and has an average grain size of 5 to 15 μm and an absolute value of charging amount of 10 to 35 μ q/g, and are mainly composed of a resin made of styrene/acrylic copolymer or a polyester and a non-organic and/or organic colorant.

9. The process of claim 1 or 2, wherein the toner is magnetic and has an average grain size of 5 to 15 μm, an absolute value of charging amount of 10 to 35 μ q/g, and a saturated magnetization of 10 to 50 emu/g, and mainly composed of a resin made of a styrene/acrylic copolymer or a polyester and magnetic fine powder, and and a content of the magnetic fine powder is not less than 15 wt %.

10. The process of claim 9, wherein the saturated magnetization of carrers is 10 emu/g or more higher than that of the toner.

11. The process of claim 1, wherein a grain size distribution of said carriers includes at least two peaks.

* * * * *